US006433736B1

(12) United States Patent
Timothy et al.

(10) Patent No.: US 6,433,736 B1
(45) Date of Patent: Aug. 13, 2002

(54) METHOD AND APPARATUS FOR AN IMPROVED ANTENNA TRACKING SYSTEM MOUNTED ON AN UNSTABLE PLATFORM

(75) Inventors: LaMar K. Timothy, Kaysville; Michael L. Ownby, deceased, late of Sandy, by Carolan P. Ownby, legal representative; Douglas G. Bowen, Spanish Fork, all of UT (US)

(73) Assignee: L-3 Communications Corp., New York, NY (US)

( * ) Notice: Subject to any disclaimer, the term of this patent is extended or adjusted under 35 U.S.C. 154(b) by 0 days.

(21) Appl. No.: 09/718,680

(22) Filed: Nov. 22, 2000

(51) Int. Cl.[7] ..... H01Q 3/00
(52) U.S. Cl. ..... 342/359; 343/757
(58) Field of Search ..... 342/359; 343/757

(56) References Cited

U.S. PATENT DOCUMENTS

| | | | | |
|---|---|---|---|---|
| 4,630,056 A | | 12/1986 | Noguchi et al. | 342/357 |
| 5,617,317 A | * | 4/1997 | Ignagni | |
| 5,854,609 A | * | 12/1998 | Pyo et al. | 342/359 |
| 6,002,364 A | | 12/1999 | Kroeger et al. | 342/359 |
| 6,016,120 A | | 1/2000 | McNabb et al. | 342/357 |
| 6,311,555 B1 | * | 11/2001 | McCall et al. | 73/488 |

* cited by examiner

*Primary Examiner*—Theodore M. Blum
(74) *Attorney, Agent, or Firm*—Perman & Green, LLP

(57) ABSTRACT

An apparatus for an improved antenna tracking system for antennas mounted on an unstable platform. The system comprising a directional antenna, an attitude heading reference system (AHRS) mechanically connected to the at least one directional antenna, a self-scan acquisition and tracking method and an antenna controller connected to the AHRS.

8 Claims, 8 Drawing Sheets

METHOD AND APPARATUS FOR AN IMPROVED ANTENNA TRACKING SYSTEM MOUNTED ON AN UNSTABLE PLATFORM

BACKGROUND OF THE INVENTION

1. Field of the Invention

The present invention relates to antenna tracking systems and to antenna tracking systems mounted on unstable platforms. More particularly, the present invention relates to step track systems using a computer signal process generally known as a Kalman Filter.

2. Prior Art

Conventional methods for using an antenna to track a radio frequency (RF) source, such as from a satellite, use expensive monopulse or conical scan (conscan) methods. For example, the conscan method determines pointing errors by using extra hardware to intentionally off center the antenna bore-sight in a conical beam pattern about the RF source. Moreover, when the antenna is mounted aboard a vessel subject to heavy seas, maintaining antenna tracking of the satellite's RF beacon requires positioning data of the antenna relative to the ship's roll and yaw motion; otherwise known as the attitude and heading reference of the antenna relative to the ship's attitude and reference. The ship's attitude and heading information is typically provided by expensive inertial navigation systems mounted to the ship. However, inertial navigational systems are not typically suitable, due to weight and size, to mount directly to the antenna pedestal or dish. For this reason the attitude and heading reference of the antenna is typically derived from the ship's inertial navigation system thereby introducing errors into the closed loop tracking system. Thus, it can be readily appreciated that the lack of an antenna attitude and heading reference source is a disadvantage when the antenna is mounted on a mobile platform such as a marine vessel subject to heavy seas.

SUMMARY OF THE INVENTION

It is therefore an object of the present invention to provide an improved tracking system on a mobile platform. It is further an object of the present invention to provide a system and method whereby the intentional mis-pointing of the antenna bore-sight is accomplished without the necessity of extra hardware as is typical when using conscan or monopulse methods. It is a further object of the present invention to provide attitude and heading reference data by directly mounting an attitude and heading reference system (AHRS) directly to the antenna reflector or pedestal base.

In accordance with one embodiment of the present invention an apparatus for an improved antenna tracking system for antennas mounted on an unstable platform is provided. The improved system comprises a directional antenna, an attitude heading reference system (AHRS) mechanically connected to the directional antenna reflector, and an antenna controller connected to the AHRS.

In accordance with one method of the present invention, a method for closed loop radio frequency (RF) tracking of an energy source by a directional antenna mounted to an unstable platform is provided. The method comprising the steps of mechanically attaching an attitude heading reference system (AHRS) to the directional antenna, receiving the mobile platform's internal navigation data or alternatively, receiving navigation data from the attitude heading reference system (AHRS), searching a satellite orbit pattern for an RF beacon, detecting the satellite RF beacon, and initiating self scan tracking upon detection of the satellite RF beacon.

In accordance with another embodiment of the present invention a self scan radio frequency (RF) tracking antenna apparatus with a mechanically mounted attitude reference heading system (AHRS) system, for use onboard a seagoing platform is provided. The antenna apparatus comprising at least one directional antenna, at least one AHRS mechanically connected to the at least one directional antenna; and at least one antenna controller connected to the at least one directional antenna.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 7:
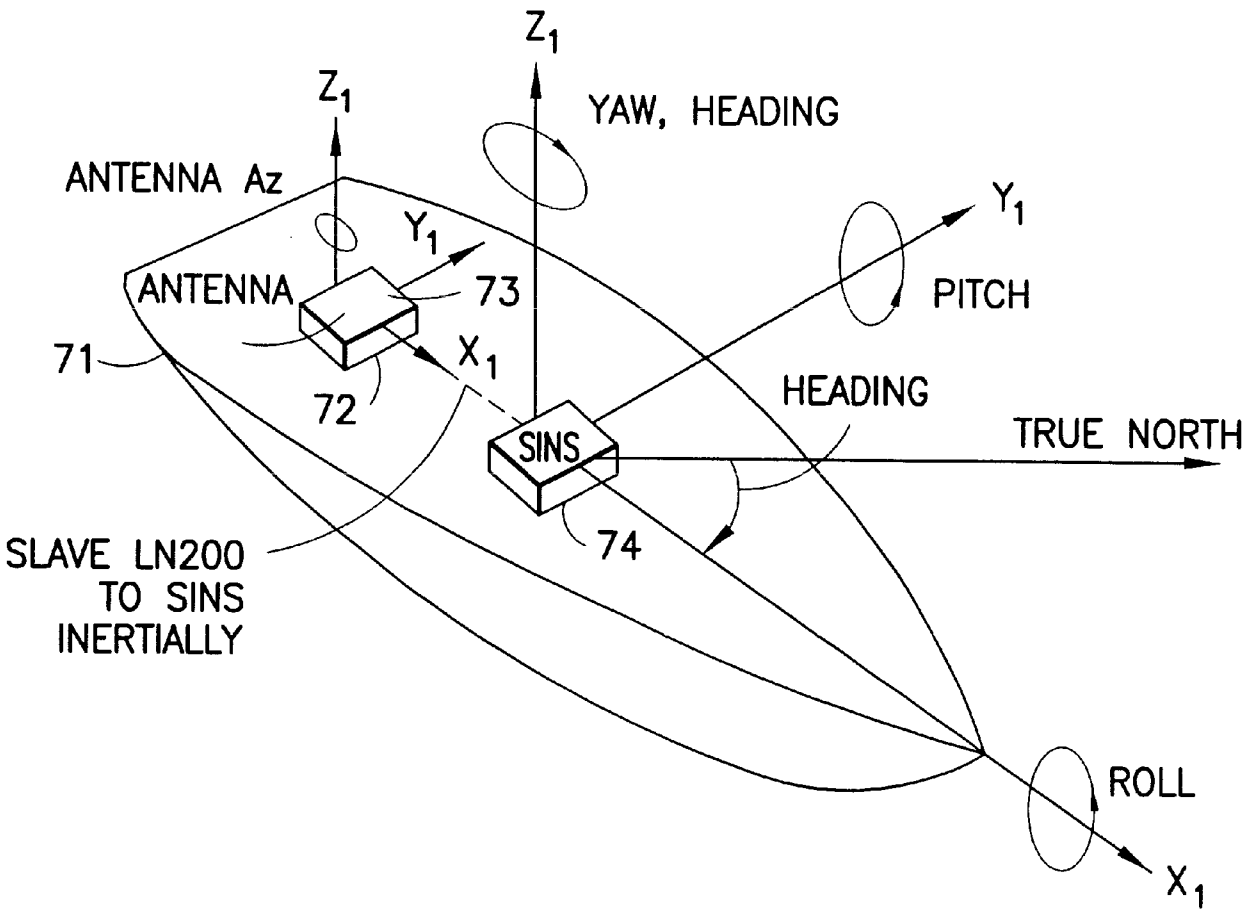
FIG. 7 is a perspective view of a ships antenna incorporating features of the present invention.

Referring to FIG. 7 a perspective view of a ship's antenna is shown incorporating features of the present invention. The present invention contemplates a step-track self-scan closed-loop control system for tracking a RF source by an antenna mounted aboard a marine vessel subject to heavy seas. Although the present invention will be described with reference to the single embodiment shown in the drawings, it should be understood that the present invention can be embodied in many alternate forms of embodiments.

Due to servo bandwidth limitations, the self-scan closed-loop controller operates at considerably lower scan rates than a typical conical scan. Following a command to mis-point to a new direction, the self-scan controller requires approximately 200 msec to move to the new position and stabilize. After the servo position becomes stable, the AGC signal which indicates the RF signal strength is allowed to stabilize.

Digital compensation in the azimuth and elevation drive control systems is incorporated so that adequate phase and gain margins required for a stable control system can be obtained. This is done using simple pole-zero compensation in each axis.

When the antenna is pointed directly at the target source, the received RF power is maximum. On either side of the peak, the RF power is decreased. The beam pattern is assumed to be symmetrical, in that RF power decreases are identical for equal deviations on both sides of the peak. The decreases in power are functions of the square of the angular deviations.

In order to produce a closed-loop control system, in which pointing errors are driven to near zero, the invention advantageously mis-points the antenna intentionally by small amounts while making measurements of RF signal strength. When the peak RF energy is determined to be in a direction different than the currently assumed peak direction, then the antenna is commanded to the new direction.

The RF beam shape is assumed to be parabolic in accordance with standard antenna theory, with the peak of the parabola occurring at the direction of peak RF energy. The intention of mis-pointing of the antenna is to identify the shape of the parabola, so that the peak can be computed by mathematical means. Only three data points are required to determine uniquely a parabola mathematically, but since the data is typically noisy (both the RF signal strength measured by the AGC and the antenna attitude measured by the synchros have inherent errors), many more data points will be required to estimate the actual parabolic beam shape with confidence. In one embodiment this may be accomplished by measuring the RF strength at approximately 10 different antenna attitudes (at 300 msec intervals), and estimate the optimum parabola which best matches the data in a least squares sense. The result is used to correct the previous assumed peak RF direction according to the newly estimated peak of the parabola. In this embodiment 10 measurements taken 300 msec apart require 3 seconds total, the peak RF direction can be re-estimated every 3 seconds.

In order to determine the direction of peak RF in both azimuth and elevation directions, the antenna is preferably mis-pointed in both axes. Because the AGC circuitry continually attempts to correct for deviations in RF signal strength the AGC long term time constant preferably exceeds the time required for the least-squares data gathering sequence. If the long term AGC action is not significantly longer than the 3 seconds least squares data-gathering sequence, the data gathered will not be valid, as the peak RF data will be corrupted by the AGC. In order to further ensure that the AGC does not attempt to stabilize on an RF signal strength below the peak, the self-scan sequence preferably ensures that the antenna frequently points in the peak direction. The recommended self-scan pointing pattern resembles a bow-tie configuration and is hereafter referred to as the starfish pattern.

Thus, an advantage of the invention is the relaxation of complexity on the antenna feed structure. The "starfish" self-scan pointing pattern is accomplished mechanically, hence, no moving parts are required as part of the feed structure such as a nutated, rotating sub-reflector often used in conscan.

Advantageously, the AHRS is mounted on the antenna reflector or pedestal to provide the angular motion of the antenna relative to the SINS (mounted to the ship) as the antenna moves provides instantaneous and accurate attitude and heading references of the antenna relative to the ship's motion. In addition, the antenna motion rates measured by the AHRS' internal gyros are used to stabilize and stiffen the antenna gimbal control loops.

Pointing accuracy in the invention is achieved using an accurate INS for periodic pointing reference and a sufficiently stiff pedestal with little gear backlash. Gimbal resolvers preferably provide high pointing accuracy information. In addition, the received RF signal is preferably digitized with an accurate analog to digital converter (A/D) either in an automatic gain control (AGC) feedback loop or beacon receiver. Magnetic heading with an error as large as +/−6 degrees can be used since a raster scan can search out this error.

If the signal-to-noise ratio of the AGC indication of RF signal strength is in the range 20 to 30 db, then the least squares procedure will estimate the true direction of peak RF strength to an accuracy of under 0.1 deg in 10 samples of the starfish pattern.

In between updates from the least squares estimation procedure, the antenna pointing reference is the on-board navigator. Although the navigator has long term drift characteristics which make it unusable as the exclusive it is highly accurate in the short term and the navigator bias correction will reduce the maximum navigator errors to below 0.1 deg.

Figure 1B:
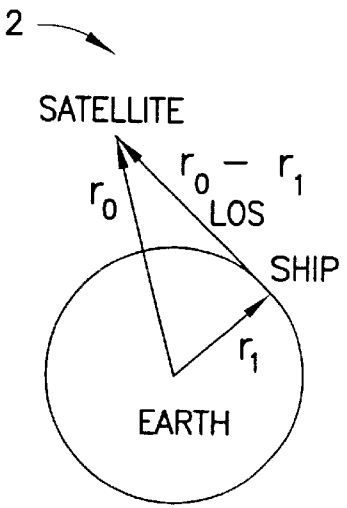
FIG. 1B is a perspective view showing the antenna coordinates of FIG. 1A in relationship to ship and earth positions.
Figure 1A:
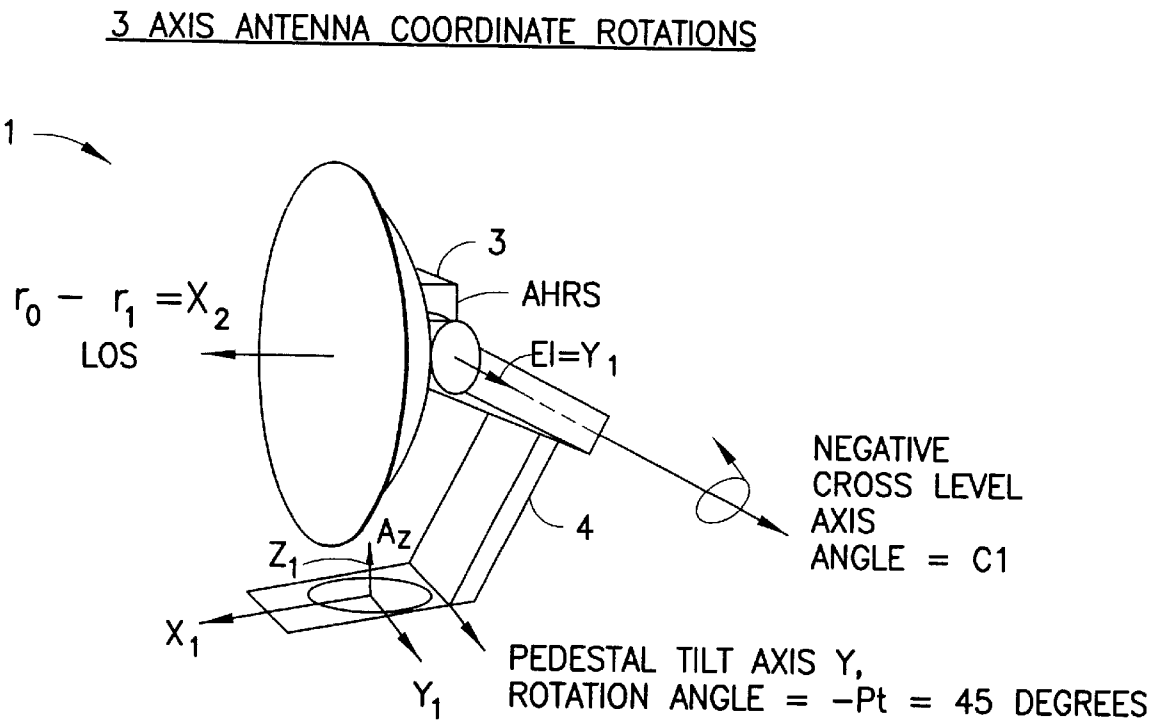
FIG. 1A is a perspective view of an antenna showing antenna coordinates and incorporating features of the present invention.

Referring now to FIGS. 1A, and 1B, the invention advantageously uses the self-scan method involving a star step pattern and the Kalman filter within an antenna pointing computer 25 that optimally estimates pointing angles. The antenna pointing computer 25 has a fast control loop from the AHRS 3 mounted directly on the antenna reflector 1 or pedestal 4 and a slow control loop of 0.1 Hz which samples the star pattern at 0.2 Hz. Using this sampled data the antenna pointing computer 25 calculates roll, pitch and heading biases applied to the AHRS 3. The max delay time between command and actual antenna response is 0.05 seconds while the ship 71 shown in FIG. 7, can roll 1.2 deg. The invention extrapolates pointing commands in 0.05 seconds to solve this problem.

Figure 2:
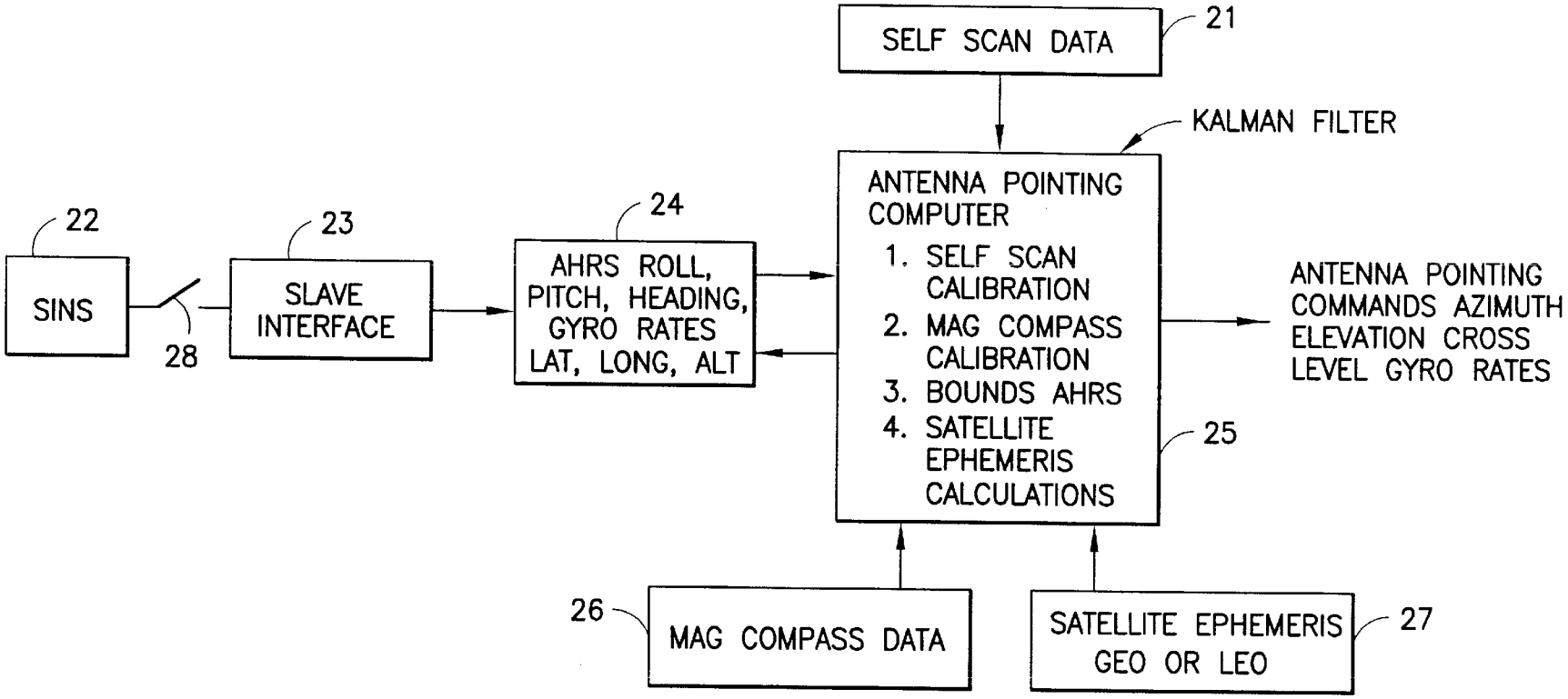
FIG. 2 is a block diagram showing a data schema for acquisition, track, and control for one embodiment of the invention.

Referring now to FIG. 2 there is shown a diagram presenting the general schema of data flow within the invention. The logic and calculations reside in the Antenna Pointing Computer 25. The basis of the computations is a Kalman filter that estimates optimally calibration biases for the antenna pedestal alignments, magnetometer azimuth error, and AHRS drift should the ships INS (SINS) malfunction. The AHRS 24 is slaved to the SINS 22 via slave interface 23 and functional switch 28. Slaving the AHRS 24 to the SINS 22 is generally accomplished with a Kalman filter. A Kalman filter is a recursive least squares curve fitter that optimally estimates dynamic regression coefficients in real time. In the case of navigation, the coefficients used in the Kalman filter are derived from position, velocity, roll, pitch, heading, and other relevant parameters based on available input data such as measured acceleration, antenna azimuth tracking, and magnetometer azimuth data. The antenna, tracking, and magnetometer misalignments are calibrated with the Kalman filter using SINS data. If the SINS fails, these calibrated values will be applied to bound the AHRS drift for both acquisition and track. Still referring to FIG. 2 and now FIGS. 5 and 6 there is shown the results of the antenna's self scan data 21 as input to the antenna pointing computer 25 as well as magnetic compass data 26 and satellite longitudinal data 27. The self scan data 21 results from the method described in FIG .6 and the magnetic compass data 26 and satellite longitudinal data 27 are utilized as describe in FIG. 5, steps 57 and 52, respectively.

The Antenna Pointing Computer 25 calculates antenna pointing commands for azimuth (Az), elevation (El), and cross level (Cl). These calculations are derived from the AHRS 24 data and the line of sight (LOS) to the satellite. See FIGS. 1A and 1B where the LOS is in the direction of the radial position vector difference $r_0-r_1$.

Figure 3:
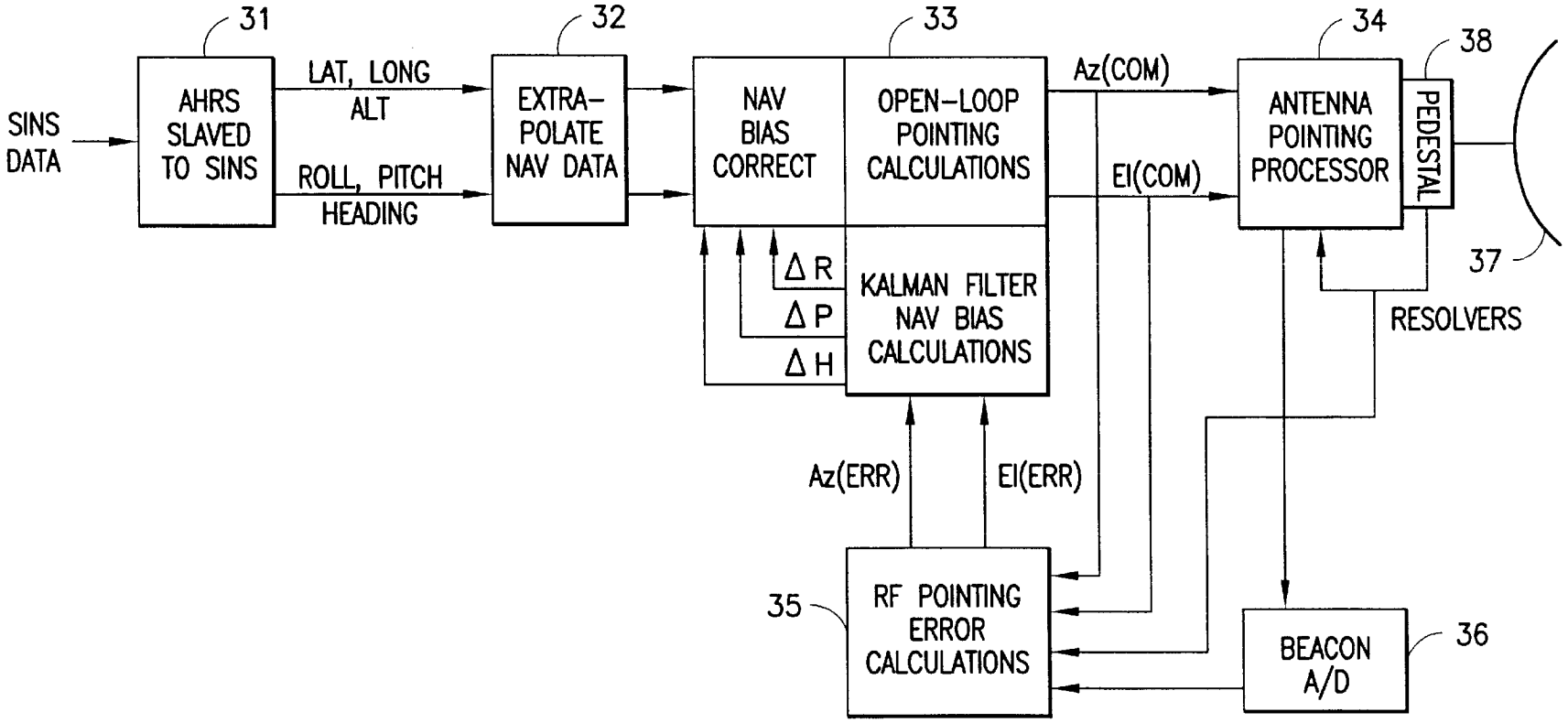
FIG. 3 is a block diagram showing data flow for self-scan mode of one embodiment of the invention.

FIG. 3 presents a schema of one embodiment of the invention. Azimuth and elevation pointing commands constitute a fast feed-forward mode while the SINS bias calculations of delta roll (ΔR), delta pitch (ΔP), and delta heading (ΔH) constitutes a slow feedback loop. The feed-forward update rate is typically 50 Hz (bandwidth of 25 Hz) while the invention feedback bandwidth is typically 0.1 Hz. The SINS bias calculations can be viewed as a calibration to the SINS-antenna pointing system to correct pedestal misalignments. When the SINS and pedestal misalignments are stable, the slow feedback mode can be discontinued allowing the antenna to point at maximum RF continually with fixed SINS biases.

The Navigator biases are calculated from data collected by mis-pointing the antenna in a starfish pattern near the expected maximum RF direction. Digitized RF and gimbal resolvers data collected from the starfish pattern are used in the Kalman filter to optimally calculate the direction of maximum received RF energy.

Figure 8:
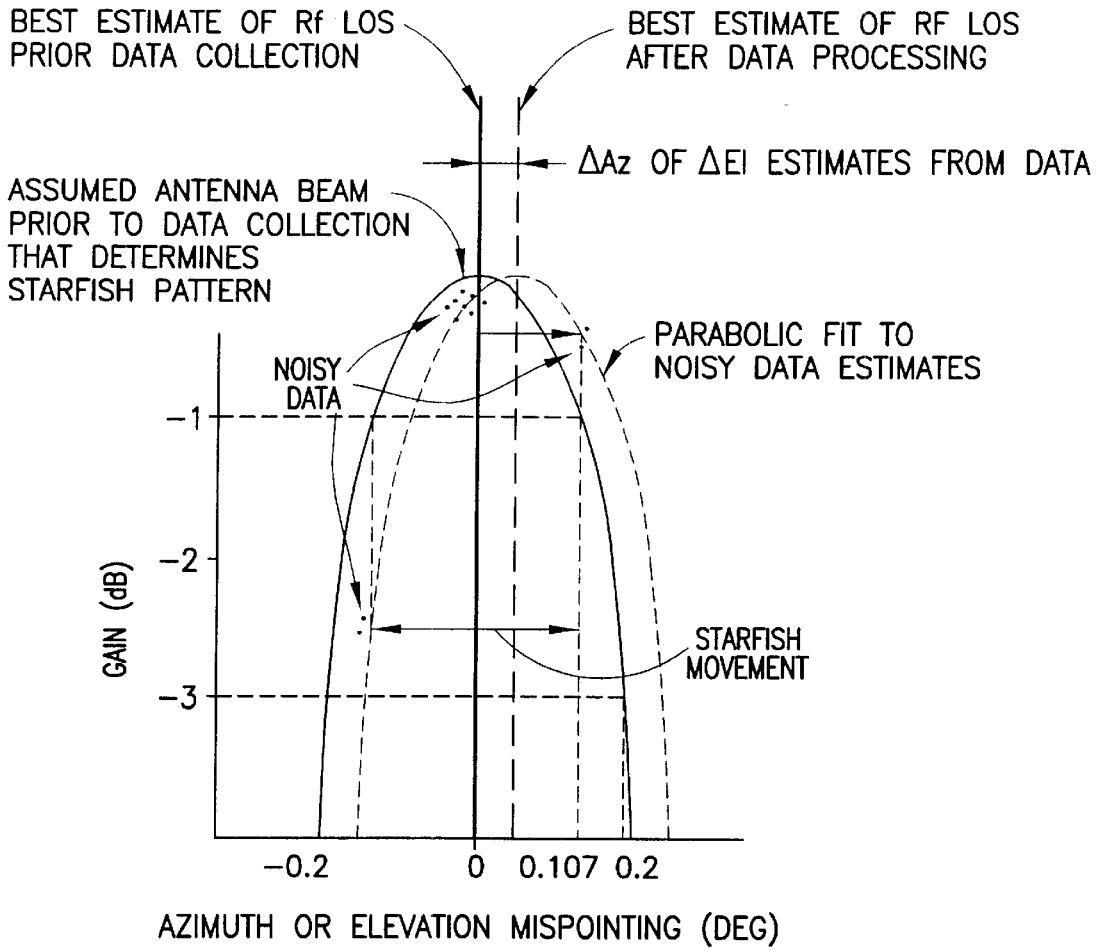
FIG. 8 is a graph of RF antenna beam pattern in dB verses LOS angle deviation.

FIG. 8 presents an example of RF antenna beam pattern in dB verses LOS angle deviation. Two parabolas that approximate antenna beam patterns are shown. The solid parabola represents the best estimate for the LOS prior to data collection. The points of the data collection are shown based on a starfish pattern relative to the solid parabola. But the data shows the LOS is not at the peak RF. A new ΔAz and ΔEl are calculated by curve fitting (Kalman filtering) to generic parabolas that estimates similar dashed parabolas as shown. Based on the new estimated ΔAz and ΔEl, a new R,P,H matrix is calculated which is unique and which is applied to the SINS data.

Referring now to FIG. 7 there is shown a perspective view of a ships antenna incorporating features of the present invention. In normal operations the SINS 74 provides pointing information through the AHRS to the antenna pointing computer 25 with an accuracy of 0.01 degrees and the AHRS is slaved to the SINS. Tracking and magnetic compass paintings are calibrated with the SINS as the calibrating source. If the SINS fails, the AHRS 73 provides antenna pointing information drifting at 0.05 degree per hr, but the drift angle is bounded at a nominal 0.1 degrees. In case of a cold start a magnetic compass (FIG. 2 item 26) providing magnetic compass data is used for initial acquisition where +/−6 degree error in azimuth is acceptable for starting a search, after acquisition azimuth information is provided to bound the heading error of the AHRS 73.

A feature of the invention's self-scan method is the measurement of automatic gain control (AGC), RF or intermediate frequency (IF) power changes as the antenna is commanded to step about the center of the RF beam. The step sizes are preferably within 1 db of maximum power of the main antenna lobe. In one embodiment of the invention the 1 db variation corresponds to +−0.5 deg of antenna pointing. This requires a long term (3 seconds) stable RF input signal and a favorable signal to noise ratio of the IF detected signal since data for each correction update cycle will be gathered over the 3 seconds.

RF power levels at the IF stage can change by large amounts. However, most changes are unwanted. Only RF changes caused by changes in pointing direction of the antenna are wanted. Unwanted changes are caused by:

1. Range variations of 1 nmi to 23,000 nmi (−40 dbm to −108 dbm).
2. Environmental effects of multi-path, fades, etc.
3. Radome effects.
4. Noise in the RF receiver section.

Both wanted and unwanted changes may be characterized by frequency or how fast they change and if they are self correlated (autocorrelated) or purely random. With these characterizations, AGC and circuit time constants as well as filter bandwidths can be selected which discriminate against the unwanted effects. Furthermore, proper use of navigator data is a significant source of information for discrimination purposes.

The AGC preferably keeps its output within the range of the 12 bit A/D. The least squares method of calculating error pointing is independent of the absolute average magnitude of the AGC.

The environmental effects that vary slower than 0.1 Hz, likewise, will be leveled out by the IF AGC. On the other hand, environmental effects that vary faster than 0.1 Hz can be discriminated against using the fact that the navigator gyros are specified not to drift faster than 4.5 deg/hr or 0.00125 deg/sec. If the estimated self-scan correction in the navigator attitude angles is greater than about 0.05 deg, the correction preferably not applied because this magnitude could not statistically be justified by normal (expected) step track variations.

Figure 6:
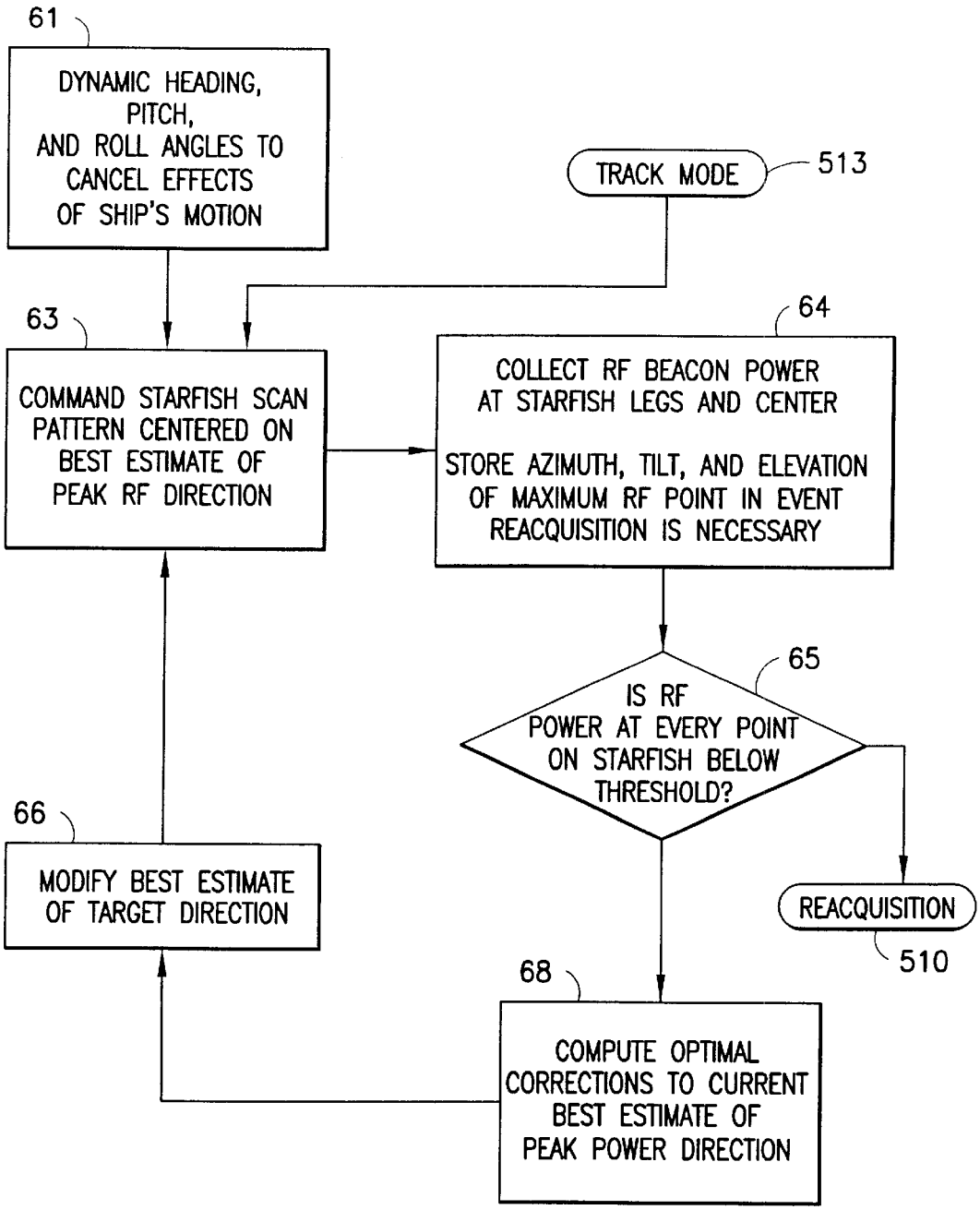
FIG. 6 is a flowchart showing the steps for tracking the RF beacon acquired in FIG. 5.

Noise in the RF receiver section shall be discriminated against by bandpass filtering the IF signal such that 20 db S/N is achieved at the input to the analog-to-digital converter (A/D). The AID shall be 12 bits with the least significant bit corresponding to a change in peak RF-IF signal of a specified db. The first two or three least significant bits are expected to be noise. The Gaussian character of the noise is preferably preserved for the least squares fit. The 12 bit range is preferable to accommodate large changes in raw RF signal caused by range and environmental changes. Note that the signal into the A/D will be a low frequency pass band signal. The lower cutoff is preferably about 0.1 Hz and the upper cutoff frequency is preferably about 500 Hz. Referring now to FIG. 6, there is shown the top diagram shows a RF-IF signal flow. At IF a signal is picked off for dedicated step track processing.

The IF signal is passed through a narrow pass-band filter (PBF). The bandwidth is selected such that at least a 20 db S/N ratio is realized at the input to the A/D. The filter is likely to be realized with a surface acoustic wave (SAW) filtering device mounted on a strip line. The signal-to-noise (S/N) ratio at this point is positive. The signal is passed to an AGC as shown in the lower functional diagram. An attenuator is shown controlled by a near D.C. signal out of an operational amplifier which is essentially an integrator. The closed-loop time constant of the AGC should be at least 10 times longer than the time to execute one step in the self-scan data collection process.

The IF gain amplifier is selected such that the output of the IF AGC is preferably within a specified tolerance for ranges between 1 and 23,000 nmi and the closed-loop time constant is greater than 10 seconds. The diode detector is preferably of such quality as not to degrade the 20 db S/N ratio requirement (Section 8). The signal from the diode detector is preferably fast enough to follow the change in RF level as the step motion is carried out. Consequently, the low pass filter shown should have a time constant less than 2 msec.

During acquisition, large changes in AGC output will occur. Before acquisition, the AGC attenuator will achieve near zero attenuation, since no signal is present. When an RF signal is first detected, the diode detected signal will go very high for possibly 10 seconds while the integrator is reacting. Meanwhile the A/D will put out a max signal which shall be used for a track signal detect for commanding the system from the Acquisition mode into the Track mode.

Figure 5:
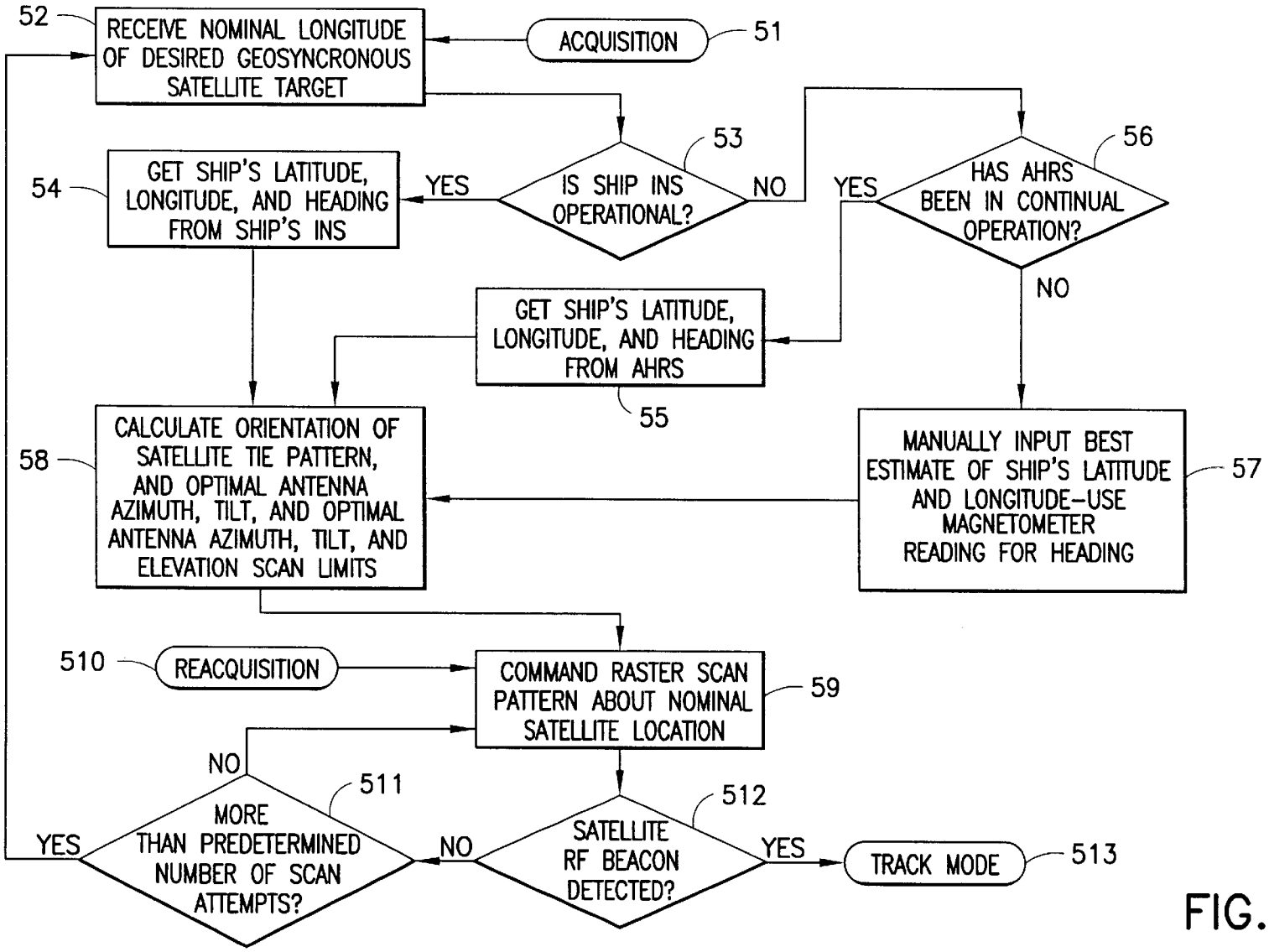
FIG. 5 is a method flowchart showing the steps for acquiring a satellite RF beacon.

Referring now to FIGS. 3 and 5 there is shown a block diagram showing data flow for self-scan mode of one embodiment of the invention and method flowchart showing the steps for acquiring a satellite RF beacon, respectively. The acquisition mode 51 begins by receiving 52 a nominal longitude of a desired geo-synchronous satellite. The next step 53 determines if the ship's inertial navigation (SINS) system is operational. If SINS is operational then ship latitude, longitude, and heading are received 54 from the SINS by the AHRS 31. Otherwise, a determination of the attitude heading reference system's (AHRS) operational status is made 56. If AHRS 31 has been in continuous operation then the ship's latitude, longitude, and heading are received 55 from the AHRS. If the AHRS has not been in continuous operation then the ship's position and heading are manually entered into the system. Once the ship's position and heading have been entered, either manually or otherwise, the next step 58 calculates the orientation of the satellite starfish pattern, and optimal antenna azimuth tilt, optimal antenna elevation tilt, elevation scan limits 32. The next step 59 commands the antenna to perform a raster scan in the azimuthal and elevational planes in the starfish pattern about the satellite's nominal position. The antenna pointing processor 34 determines if the satellite RF beacon has been detected 512. If detection is made then the antenna pointing processor transitions to the track mode 513. Otherwise, the system makes a predetermined number of attempts to scan for the RF beacon. If the antenna pointing processor determines 511 that the predetermined number has been exceeded the system returns to receiving a nominal longitude of the desired geo-synchronous satellite target 52.

Referring also to FIG. 6 there is shown a flowchart showing the steps for track mode 513 after the RF beacon has been acquired in FIG. 5. Dynamic heading, pitch, and roll angles are entered 61 into the antenna pointing computer to offset effects of ship's motion. The antenna pointing computer commands 63 a starfish scan centered on the best estimate of the peak RF direction. During the starfish scan, the received RF beacon power at the outer legs of the starfish pattern and center are determined 64. In addition, the parameters associated with the antenna's azimuth, elevation, and tilt when detecting maximum RF signal is stored 64 in the event that reacquisition is necessary. The next step 65 determines if the RF power at the starfish legs and center is below a predetermined threshold. The predetermined threshold may be determined experimentally or set according to the RF power radiated by the satellite. If the RF power at the measured points is below the predetermined threshold the system reverts to reacquisition 510. Otherwise, the next step computes 68 optimal corrections to the current best estimate of peak power direction by calculating the RF pointing errors 35 derived from the analog-to-digital function 36 which is then used to modify 66 the current best estimate of the RF beacon direction. The modified current best estimate of the RF direction is combined with the ship's instantaneous position and the antenna's instantaneous position by the antenna pointing computer 33 to command 63 the antenna pointing processor 34 to move the antenna 37 supported by a pedestal 38 in a starfish pattern scan about the modified best estimate of the RF direction.

Every 62.5 msec, the incoming azimuth and elevation commands to the antenna processor 34 are each received serially as a 16-bit fixed point word with a range of −180 deg. to +180 deg. At the same time, the synchronizer positions are sampled by 14-bit synchronizer to digital converters. Two error signals, one for azimuth and one for elevation, are formed by the difference between the commanded angles and the measured angles. These error signals are digitally compensated through signal processing and sent to the MDAC's (multiplying digital to analog converters) which convert the digital signals to 400 Hz motor command voltages. The motors then move the antenna to the correct position.

Figure 4:
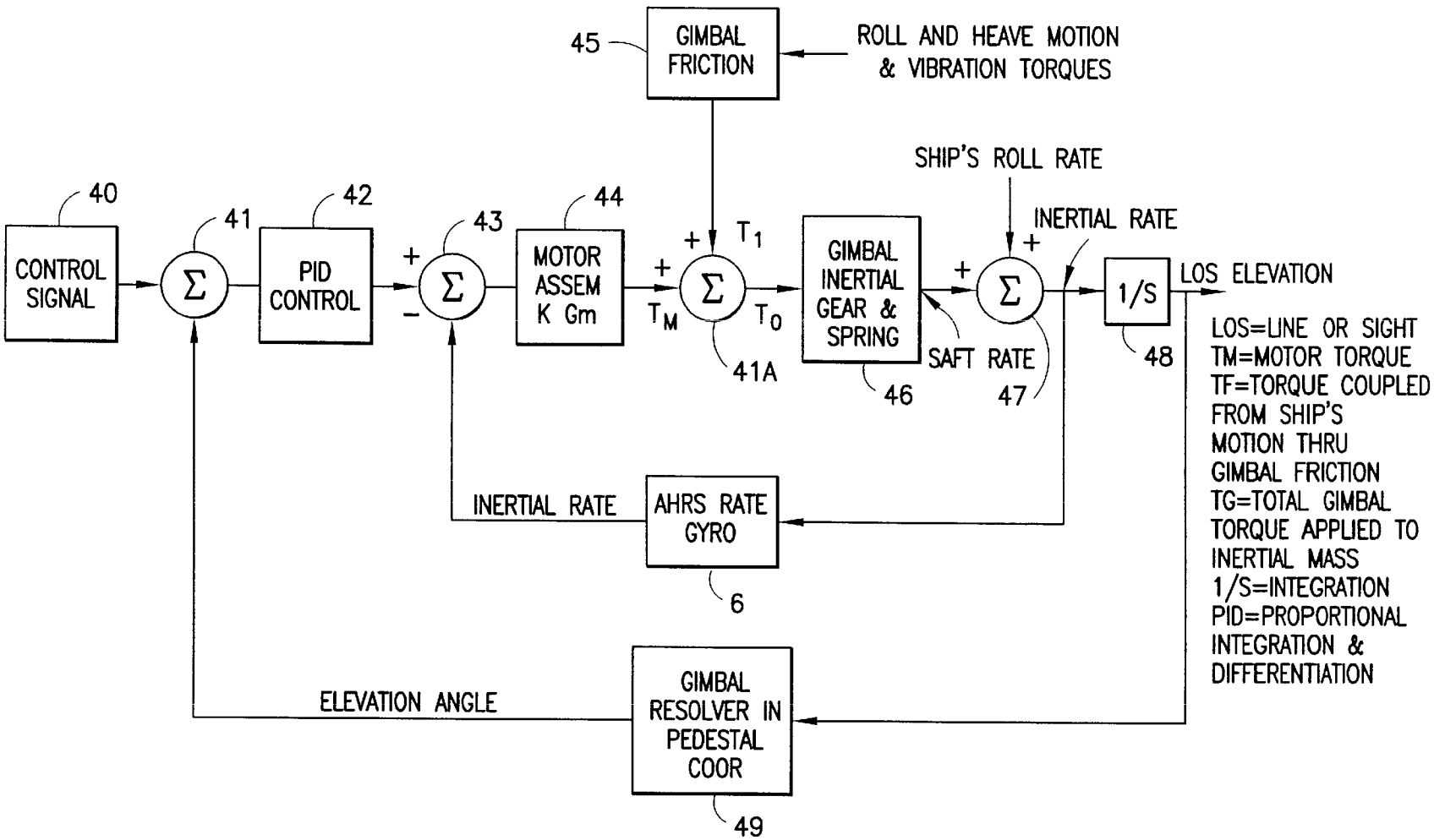
FIG. 4 is a block diagram showing a control loop schema for antenna elevation gimbal control in one embodiment of the invention.

Referring also to FIG. 4 there is shown a block diagram showing a control loop schema for antenna elevation gimbal control in one embodiment of the invention. The control signal 40 is summed at summer 41 with elevation angle information provided by gimbal resolvers in pedestal 38. The summed value is provided to proportional integration and differentiation (PID) control 42 where the output is summed at summer 43 with inertial rates provided by the AHRS 6 mounted to the antenna 37 or pedestal 38. This value is combined with motor assembly parameters 44 to produce motor torque. The motor torque is summed with the torque coupled from the ship's motion through gimbal friction at summer 41A. The output of summer 41A is the total gimbal torque applied to the gimbal inertia gear and spring 46 to produce the shaft rate. The shaft rate is then summed with the ship's roll rate at summer 47 to produce the inertia rate. The inertia rate is then integrated by integrator 48 to produce the line-of-sight (LOS) elevation. In addition, the LOS is used as feedback to gimbal resolver 49. A similar control loop is used for the azimuthal gimbal control.

The above AGC assumptions are represented by the equation of a parabola:

$$\text{RFPOWER}=a*DELAZ^2+b*DELAZ+c$$

where

RFPOWER=magnitude of RF power received

DELAZ=angular deviation of the antenna $$(DELAZ=AZ-AZ\text{REF})$$

AZREF=reference angle (assumed direction of peak)

AZ=antenna angle measured by the antenna synchro a,b,c=unknown constants

Although the symbol AZ (for azimuth) is used exclusively in this derivation, a similar mathematical development is applicable to EL (elevation) as well. In fact, duplicate calculations are preferably performed to do both AZ and EL.

The RFPOWER vs DELAZ equation has the following properties:

(1) If the antenna reference angle AZREF is exactly in the direction of peak RF power, then DELAZ would be zero at the peak, and constant c would equal identically the peak RF power available.

(2) Whenever constant b is nonzero, the parabola is not symmetrical about the reference direction. Since AZREF is assigned the position currently believed to be the direction of peak RF, a nonzero b indicates AZREF is in error.

(3) Since constants a, b, and c are unknown, they are preferably estimated.

In the antenna the AGC circuitry actually operates on the down converted IF signal. By assumption, the IF power is in direct proportion to the RF power. Multiplying the RFPOWER vs. DELAZ equation by a constant proportionality factor will change constants a, b, and c by the constant factor.

However, the same parabolic relationship applies—only the magnitudes of the constants a, b, c change—their ratios remain fixed.

The peak of the RF given by the RFPOWER vs. DELAZ equation is obtained by taking the derivative of the equation with respect to DELAZ, setting the result equal to zero, and solving for DELAZ:

$$d(\text{RFPOWER})/d(DELAZ)=2*a*DELAZ+b=o$$

Solving, $$\text{Peak } DELAZ=-b/2a$$

This result implies that the real peak of the RF power occurs at an angle b/2a away from the assumed direction AZREF. Therefore, AZREF should be updated:

$$\text{New } AZREF=\text{Old } AZREF-b/2a$$

Note that constant c has no direct use in the update calculation. This might have been anticipated, since the absolute magnitude of the signal power has nothing to do with the location of the peak. However, when AZREF is not in the direction of peak RF power, c does not represent exactly the peak RF magnitude and the values of constants a and b are different than they would be with correct AZREF. Rather the peak RFPOWER for nonzero b is given by substituting DELAZ =−b/2a and solving:

$$\text{Peak RFPOWER}=-b^2/4a+c$$

The point is that even though c does not enter into the correction calculation, optimal results cannot be had if constant c is left out of the model, e.g. if $$\text{RFPOWER}=a*DELAZ^2+b*DELAZ$$

and only a and b are estimated.

However, it is important to note that since only the ratio b/a is involved in the AZREF correction, it is irrelevant whether RF or IF signal powers are available. Thus, the antenna AGC signal which operates on IF is entirely adequate.

Since there are three unknown constants a,b,c, associated with the RFPOWER vs. DELAZ equation, they could be solved for directly via straightforward arithmetic after three AGC measurements are made (at different AZ angles). However, this approach is not recommended, because the ACG measurements are noisy, and the estimated constants would be relatively inaccurate, depending on the magnitude of the noise.

The recommended approach is to make a larger number of measurements before estimating a, b, and c, so that the unwanted noise can be averaged out. The model becomes:

$$\text{IFPOWER}=a*DELAZ^2+b*DELAZ+c+\text{NOISE}$$

where IFPOWER has replaced RFPOWER for reasons discussed above, and where the new a, b, and c will have different magnitudes than the previous model. The new quantity, NOISE, represents "error" in the model.

Assume that p measurements are taken. Arrange the p measurements of IFPOWER in a column vector (call it $\underline{I}$). In the measurements, there are also p different NOISE values, although their magnitudes are of course unknown at this point. Assume they form another similar vector (designated $\underline{N}$). The p different DELAZ measurements are arranged in a p×3 matrix, called X:

$$X=\begin{bmatrix} DELAZ_1^2 & DELAZ_1 & 1 \\ DELAZ_2^2 & DELAZ_2 & 1 \\ \vdots & \vdots & \vdots \\ DELAZ_p^2 & DELAZ_p & 1 \end{bmatrix}$$

Finally arrange the unknown constants a, b, and c in column vector designated $\underline{a}$.

$$\underline{a}=\begin{bmatrix} a \\ b \\ c \end{bmatrix}$$

The vector-matrix equation representing all of the p measurements then becomes:

$$\underline{I}=X\underline{a}+\underline{N}$$

$$(p\times 1)(p\times 3)(3\times 1)(p\times 1)$$

The problem is to find (or "estimate") unknown constant vector $\underline{a}$ such that error vector $\underline{N}$ is minimized.

First rearrange the vector equation to solve for $\underline{N}$:

$$\underline{N}=\underline{I}-X\underline{a}$$

One approach would be simply to adjust elements of $\underline{a}$ through some known technique until the elements of $\underline{N}$ are minimum. However, elements of $\underline{N}$ may assume both positive and negative values, so it is difficult to determine through analytical means what changes in elements of $\underline{a}$ will have an optimal effect on all elements of $\underline{N}$.

Another approach is to multiply $\underline{N}$ by its transpose to create a scalar quantity J:

$$J=\underline{N}^T\underline{N}$$

Now it is straightforward to determine if changes in $\underline{a}$ decrease the magnitude of elements of $\underline{N}$, because J will decrease whenever $\underline{N}$ changes in the desired direction. Accordingly, J is called a "criterion function," and we desire J to achieve a minimum value. Since this technique involves the square of the error vector and we are searching for a minimum, it is known as "least squares."

The $\underline{a}$ which minimizes J can be calculated by taking the derivative of J with respect to $\underline{a}$, setting the result equal to zero, and solving for $\underline{a}$:

$$d(\underline{N}^T\underline{N})/d(\underline{a})=2(\underline{I}-X\underline{a})^T(-X)=0$$

$$X^T(\underline{I}-X\underline{a})=0$$

$$\underline{a}=(X^TX)^{-1}X^T\underline{I}$$

$$(3\times 1)(3\times 3)(3\times p)p\times 1)$$

Note that the least squares technique involves inverting a matrix (in this particular case, a 3×3 matrix, since there are three unknown constants).

After $\underline{a}$ is estimated, it is straightforward to determine the true direction of peak RF and update the reference angle:

$$\text{New } AZREF=\text{Old } AZREF-b/2a$$

since a and b are elements of $\underline{a}$.

Noise in the AGC signal is a function of several physical phenomena, including weather, clouds, multipath, thermal noise in the receiver, etc. Filtering within the AGC circuitry will reduce the noise power in relation to the desired signal power. The signal to noise (S/N) power ratio is expressed in db:

$$(S/N)_{db}=10 \log (S/N)_{watts}$$

Thus, it can be readily appreciated that one feature of the invention advantageously attaches the AHRS directly on the antenna reflector or pedestal base via mechanical attachment. Such mechanical attachment reduces costs from approximately $100,000 USD for a dedicated inertial navigator to approximately $8,000 USD for a typical AHRS. Combining this feature with the other features of the invention advantageously provides a method and apparatus for an improved antenna tracking system mounted on an unstable platform.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An apparatus for an improved antenna tracking system for an antenna mounted to an unstable platform, the system comprising:

at least one directional antenna;

at least one attitude heading reference system (AHRS) directly mechanically connected to the at least one directional antenna; and at least one antenna controller connected to the at least one AHRS.

2. An apparatus for an improved antenna tracking system as in claim 1 wherein the at least one antenna controller further comprises:

an antenna pointing processor;

an open-loop pointing calculator connected to the antenna pointing processor;

a navigational bias calculator connected to the open-loop pointing calculator;

a navigational bias corrector connected to the navigation bias calculator, the navigational bias corrector having means for receiving navigational data;

a radio frequency (RF) pointing error calculator connected to the navigational pointing bias calculator; and a beacon analog to digital converter (ADC) connected to the RF pointing error calculator.

3. A method for closed loop radio frequency (RF) tracking of an energy source by a directional antenna mounted to an unstable platform, the method comprising the steps of:

directly mechanically attaching an attitude heading reference system (AHRS) to the directional antenna;

receiving the mobile platform's internal navigation data or alternatively, receiving navigation data from the attitude heading reference system (AHRS);

determining a satellite orbit pattern;

searching the satellite orbit pattern for an RF beacon;

detecting the satellite RF beacon; and initiating self scan tracking upon detection of the satellite RF beacon.

4. A method as in claim 3 where the step of determining a satellite orbit pattern further comprises the steps of:

calculating an orientation of the satellite orbit pattern; and calculating optimal degree of freedom (DOF) limits.

5. A method as in claim 3 where the step of searching the satellite orbit pattern for an RF beacon further comprises the step of maneuvering the directional antenna in a starfish pattern.

6. A self scan radio frequency (RF) tracking antenna apparatus with directly mechanically mounted attitude reference heading system (AHRS) system, for use onboard a seagoing platform, the apparatus comprising:

at least one directional antenna;

at least one AHRS directly mechanically connected to the at least one directional antenna; and at least one antenna controller connected to the at least one directional antenna.

7. A self scan radio frequency (RF) tracking antenna apparatus as in claim 6 wherein the at least one AHRS mechanically connected to the at least one directional antenna further comprises:

the directional antenna having a focusing parabola reflector; and the AHRS mechanically connected to the focusing parabola reflector.

8. A self scan radio frequency (RF) tracking antenna apparatus as in claim 6 wherein the at least one AHRS mechanically connected to the at least one directional antenna further comprises:

the directional antenna having a supporting pedestal; and the antenna mechanically connected to the supporting pedestal.

* * * * *